US006687963B1

(12) United States Patent
Chang

(10) Patent No.: US 6,687,963 B1
(45) Date of Patent: Feb. 10, 2004

(54) BUCKLE STRUCTURE FOR FASTENING SHOULDER STRAPS

(76) Inventor: Ruey-Yang Chang, No. 2, Hsing Lung 2 Lane Chia Hou Rd., Wai Pu Hsiang, Taichung Hsien (TW)

( * ) Notice: Subject to any disclaimer, the term of this patent is extended or adjusted under 35 U.S.C. 154(b) by 0 days.

(21) Appl. No.: 10/394,868

(22) Filed: Mar. 24, 2003

(51) Int. Cl.[7] ..... A44B 11/25

(52) U.S. Cl. ..... 24/579.11; 24/579.09; 24/580.11; 24/702; 24/265 BC

(58) Field of Search ..... 24/163 R–165, 24/168–170, 182, 198, 175–180, 265 BC, 298, 265 R, 697.1, 300–302, 700–702, 579.09, 579.11, 580.1, 580.11; 224/627, 643, 649; 206/315.3; 2/304, 305, 310, 321, 312–315, 326–328, 331, 332, 336, 340

(56) References Cited

U.S. PATENT DOCUMENTS 2,672,309 A * 3/1954 Hatfield ..... 224/151 A
4,413,465 A * 11/1983 Blevins et al. ..... 54/46.1
4,642,855 A * 2/1987 Densmore ..... 24/310
4,993,127 A * 2/1991 Mechem et al. ..... 24/701
6,006,974 A * 12/1999 Varney et al.
6,038,747 A * 3/2000 Hamilton et al. ..... 24/164
6,168,060 B1 * 1/2001 Mayers ..... 224/645
6,283,350 B1 * 9/2001 Gottmeier et al. ..... 224/639
6,305,535 B1 * 10/2001 Fair ..... 206/315.3
6,457,620 B1 * 10/2002 Batten et al. ..... 224/645
2002/0084296 A1 * 7/2002 Roscoe-Dare

* cited by examiner

*Primary Examiner*—Robert J. Sandy
*Assistant Examiner*—Ruth C. Rodriguez
(74) *Attorney, Agent, or Firm*—Harrison & Egbert

(57) ABSTRACT

A buckle structure includes a foldable main body, two first movable connectors for fastening a first shoulder strap, and two second movable connectors for fastening a second shoulder strap. The main body is provided at one end with two first retaining holes, and at the other end with two second retaining holes. The first movable connectors are provided with a connection shaft having a retaining slot. The second movable connectors are provided with a connection shaft having a retaining projection. The first movable connectors are movably retained in the first retaining holes of the main body while the second movable connectors are movably retained in the second retaining holes of the main body. The retaining projection of the connection shaft of the second movable connectors is removably retained in the retaining slot of the connection shaft of the first movable connectors at the time when the main body is folded.

3 Claims, 8 Drawing Sheets

BUCKLE STRUCTURE FOR FASTENING SHOULDER STRAPS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a harness buckle, and more particularly to a buckle structure which is designed to fasten the shoulder straps of a shoulder bag, golf bag, or the like.

BACKGROUND OF THE INVENTION

The golf bag is generally provided with a left shoulder strap and a right shoulder strap, which are fastened therewith by a buckle. The buckle is provided with two strap holes to locate the shoulder straps. Such a conventional buckle as described above is defective in design because it is incapable of preventing the bag body from swaying at the time when the shoulder straps are caused to lean to one side. In addition, the conventional buckle cannot be folded to enable two shoulder straps to be combined into one strap. In another words, the conventional buckle lacks versatility.

BRIEF SUMMARY OF THE INVENTION

The primary objective of the present invention is to provide a buckle structure which is free of the deficiencies of the conventional buckle described above.

In keeping with the principle of the present invention, the foregoing objective of the present invention is attained by a buckle structure comprising a foldable main body, a first pair of movable connectors, and a second pair of movable connectors. The foldable main body is provided in the center with two folding grooves to facilitate the folding of the main body. The first pair of the movable connectors are movably retained in one end of the main body while the second pair of the movable connectors are removably retained in other end of the main body. In another words, the first pair of movable connectors and the second pair of movable connectors are symmetrically located. The first pair of movable connectors is used to fasten one shoulder strap while the second pair of movable connectors is used to fasten other shoulder strap. The first pair of movable connectors and the second pair of movable connectors are joined together at the time when the main body is folded.

The features and the advantages of the present invention will be more readily understood upon a thoughtful deliberation of the following detailed description of two preferred embodiment of the present invention with reference to the accompanying drawings.

DETAILED DESCRIPTION OF THE INVENTION

Figure 1:
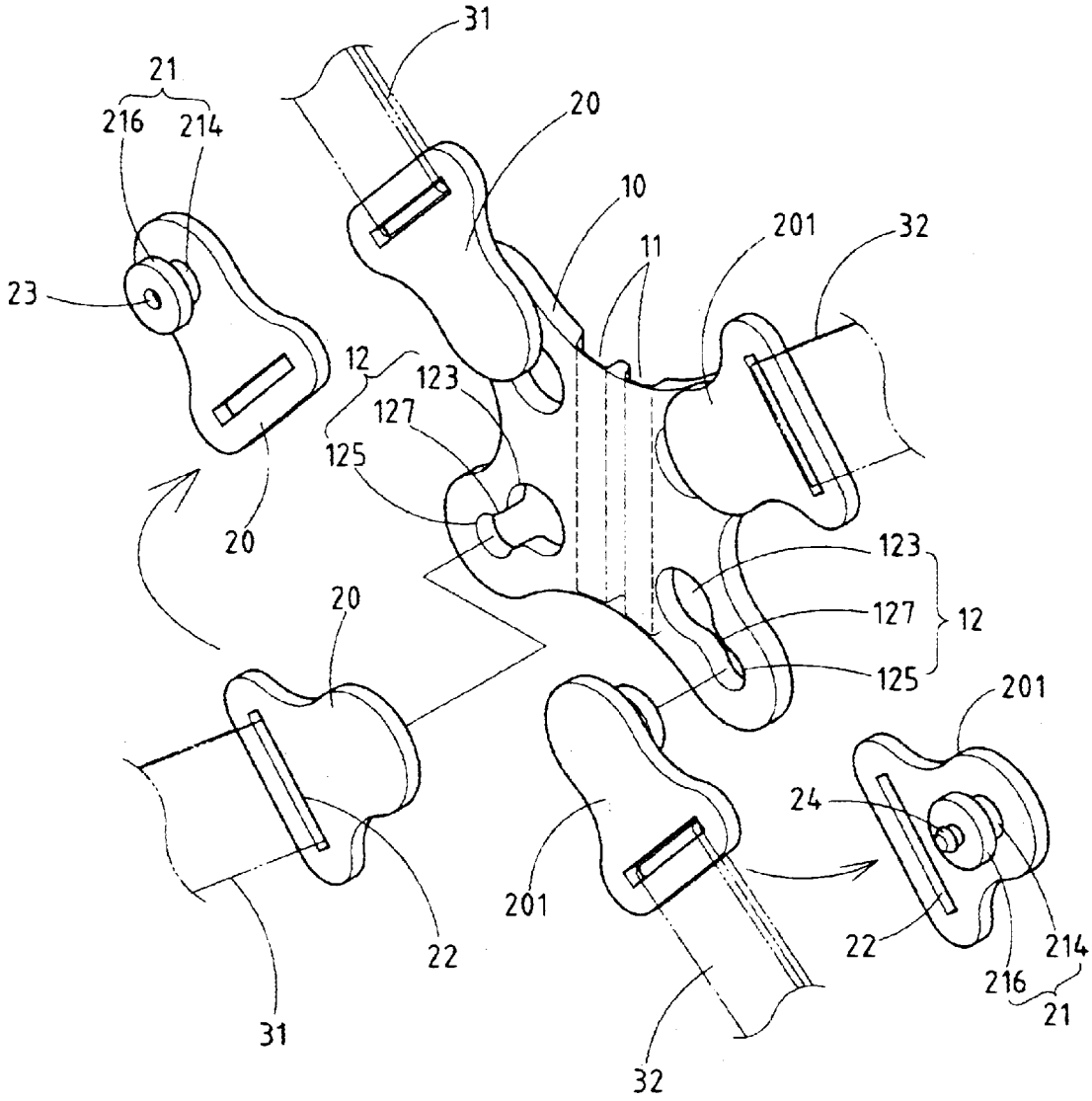
FIG. 1 shows a perspective view of a first preferred embodiment of the present invention.

As shown in FIGS. 1–7, a buckle structure embodied in the present invention comprises a foldable main body 10, two first movable connectors 20, and two second movable connectors 201. The two first movable connectors 20 are removably retained in one end of the foldable main body 10 and are used to fasten a first shoulder strap 31. The two second movable connectors 201 are movably retained in the other end of the foldable main body 10 and are used to fasten a second shoulder strap 32. The first movable connectors 20 and the second movable connectors 201 are symmetrically located. The foldable main body 10 is provided in the center with two folding grooves 11 to facilitate the folding and the unfolding of the main body 10. The main body 10 is provided with four retaining holes 12 for retaining the four movable connectors 20 and 201.

Figure 2:
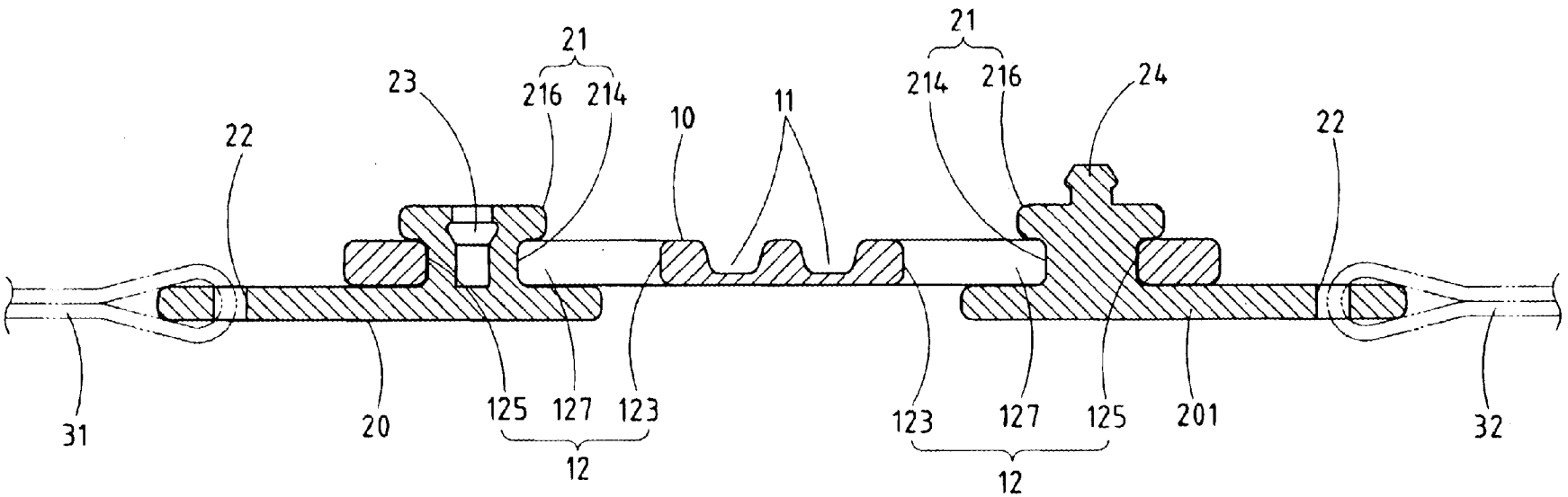
FIG. 2 shows a sectional schematic view of the first preferred embodiment of the present invention with the main body remaining in the spread-out state.
Figure 3:
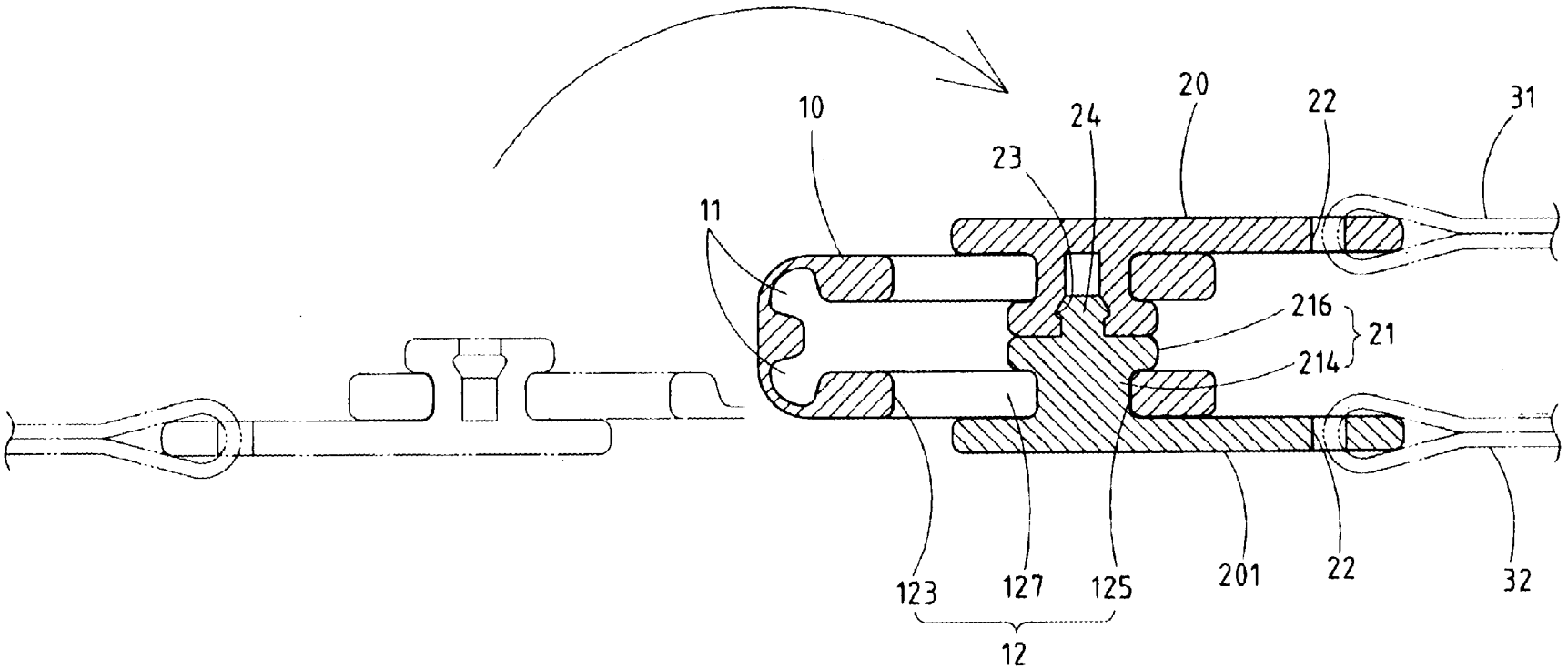
FIG. 3 shows a sectional schematic view of the first preferred embodiment of the present invention with the main body remaining in the folded state.

As shown in FIGS. 1 and 2, the two first movable connectors 20 are identical in construction and are provided with a strap hole 22 and a connection shaft 21. The strap hole 22 is used to fasten the first shoulder strap 31. The connection shaft 21 is provided at the free end with a retaining slot 23. The two second movable connectors 201 are identical in construction and are provided with a strap hole 22 and a connection shaft 21. The strap hole 22 is used to fasten the second shoulder strap 32. The connection shaft 21 of the second movable connectors 201 is provided at the free end with a retaining projection 24. The four movable connectors 20 and 201 are movable retained by the main body 10 such that the connection shaft 21 of the four movable connectors 20 and 201 are movable retained in the four retaining holes 12 of the main body 10. As the main body 10 is folded, the first movable connectors 20 and the second movable connectors 201 are joined together in such a manner that the retaining projections 24 of the connection shafts 21 of the second movable connectors 201 are removably retained in the retaining slots 23 of the connection shafts 21 of the first movable connectors 20, as shown in FIG. 3. The main body 10 is thus kept securely in the folded state.

As shown in FIGS. 1–3, the retaining holes 12 of the main body 10 are provided with a disengagement portion 123, an engagement portion 125 smaller in hole diameter than the disengagement portion 123, and a guide portion 127 located between the disengagement portion 123 and the engagement portion 125. The connection shaft 21 of the first movable connectors 20 and the second movable connectors 201 are formed of a shank 214 and a head 216. The retaining slots 23 of the first movable connectors 20 are located in the head 216 while the retaining projections 24 of the second movable connectors 201 are located in the head 216. The shank 214 is dimensioned to move through the guide portion 127 of the retaining holes 12 of the main body 10. The head 216 is dimensioned to move through the disengagement portion 123 of the retaining holes 12 of the main body 10, thereby enabling the movable connectors 20 and 201 to be separated from the main body 10.

Figure 7:
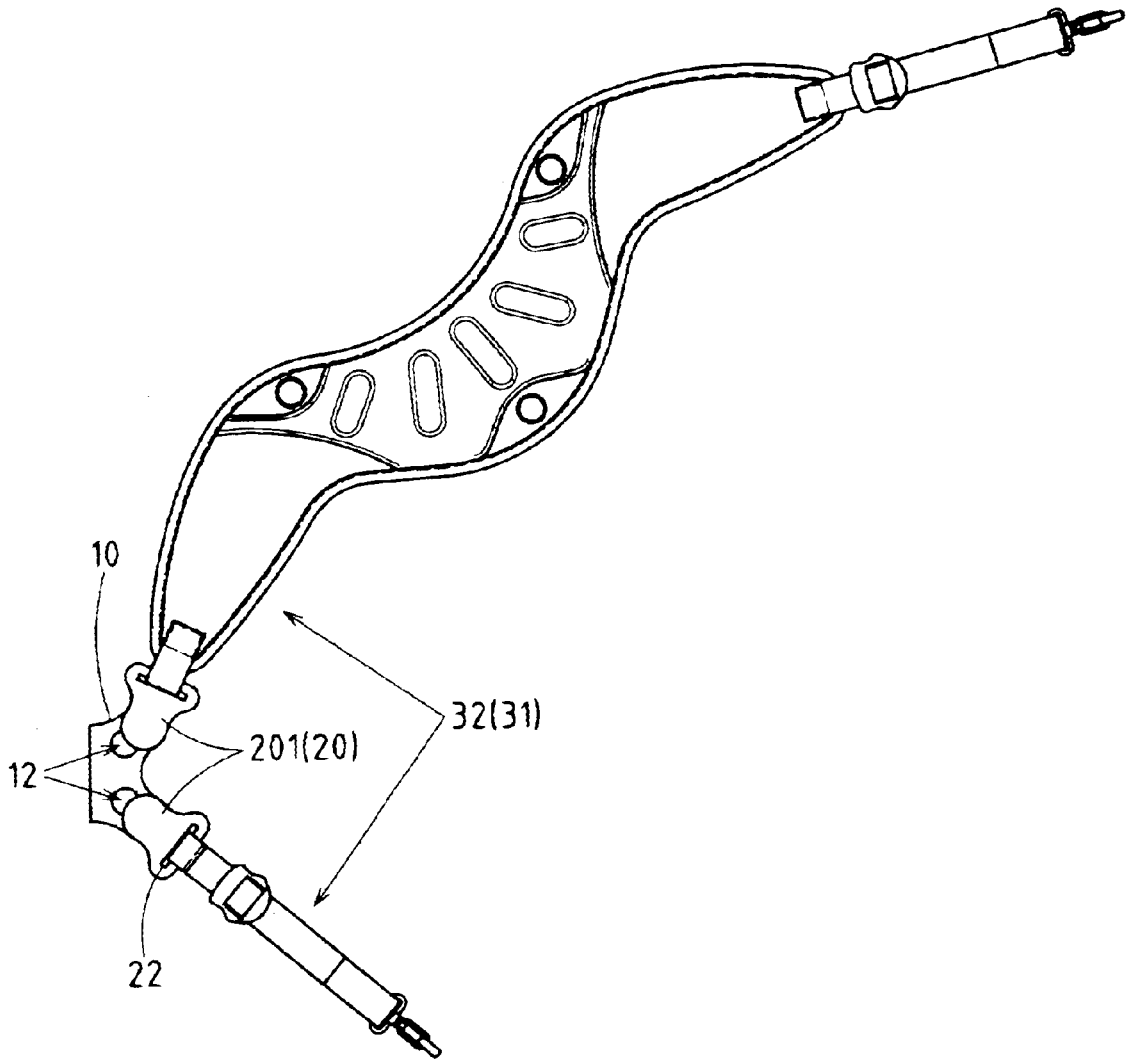
FIG. 7 shows a schematic view of the working of the folded main body of the first preferred embodiment of the present invention.

As shown in FIG. 7, the two shoulder straps 31 and 32 can be joined together to serve as a single strap by folding the main body 10. In light of the two first movable connectors 20 and the two second movable connectors 201 being arranged symmetrically, they are superimposed at the time when the main body 10 is folded. The two retaining holes 12 of the one end of the main body 10 are aligned with the two retaining holes 12 of the other end of the main body 10 at the time when the main body 10 is folded.

Figure 8:
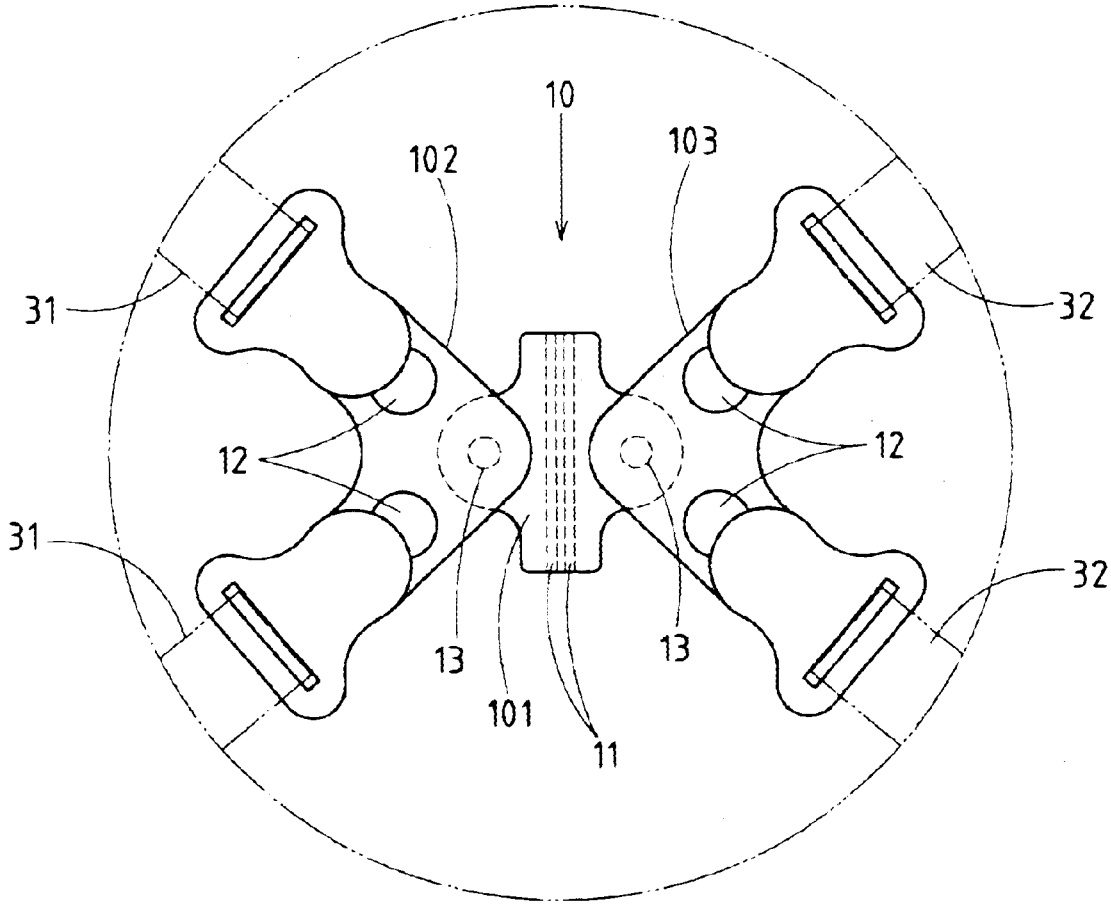
FIG. 8 shows a schematic plan view of a second preferred embodiment of the present invention.

As shown in FIG. 8, the main body 10 of the present invention is formed of a center piece 101, a left piece 102, and a right piece 103. The center piece 101 is provided in the center with the two folding grooves 11. The left piece 102 and the right piece 103 are pivoted to the center piece 101 by a pivot 13 and are provided with two retaining holes 12.

Figure 4:
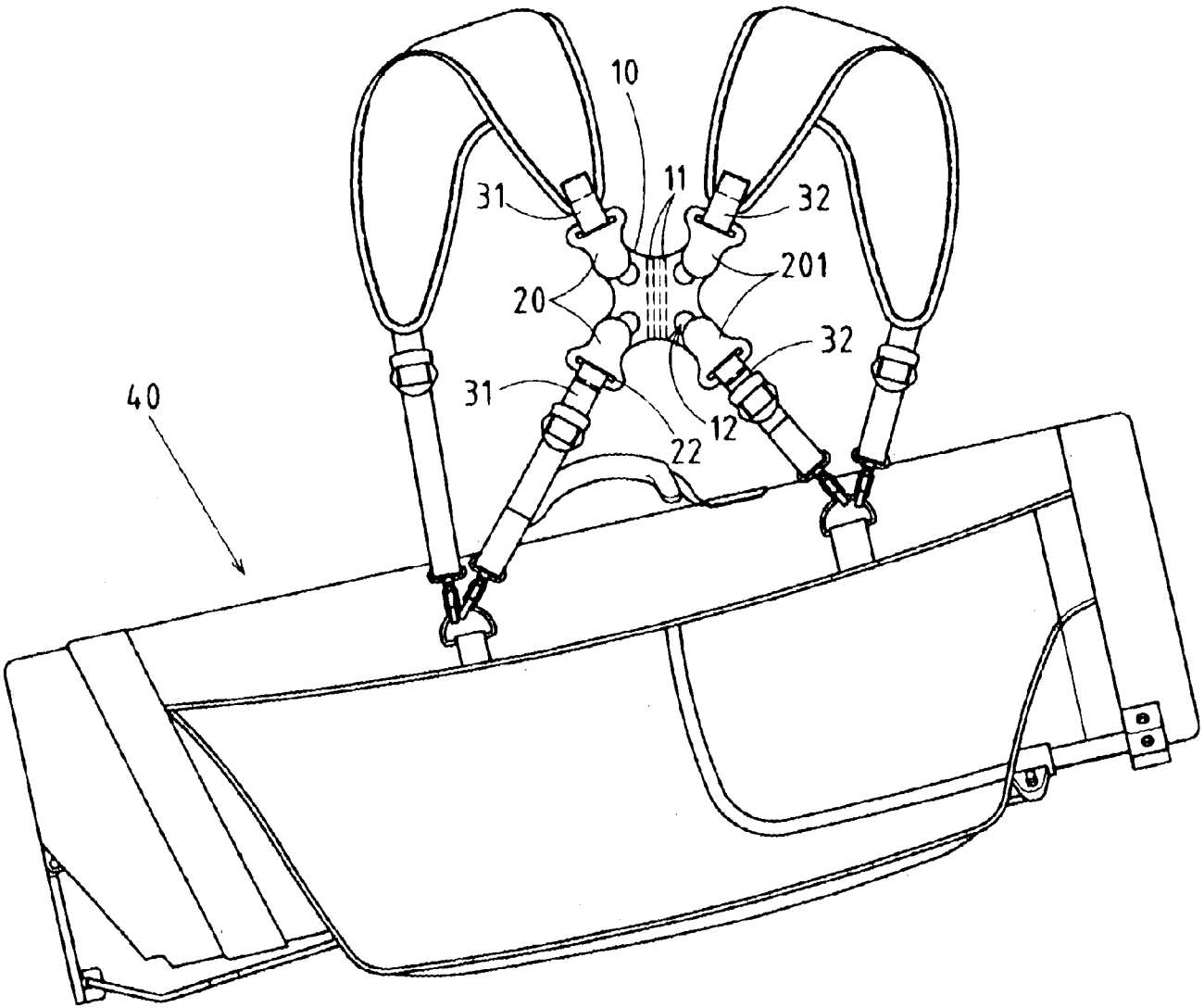
FIG. 4 shows a schematic view of the first preferred embodiment of the present invention at work.
Figure 5:
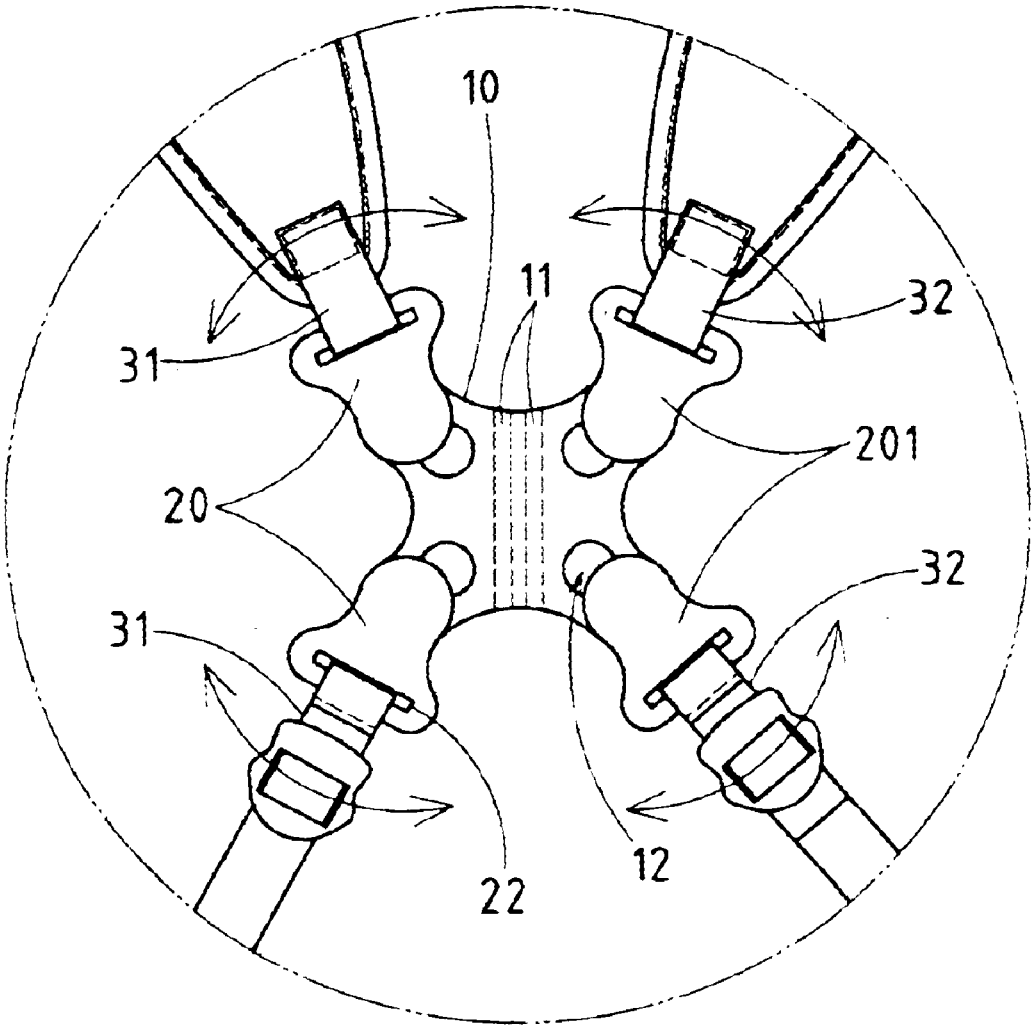
FIG. 5 shows a schematic view of the movable connectors in motion in relation to the main body of the first preferred embodiment of the present invention.
Figure 6:
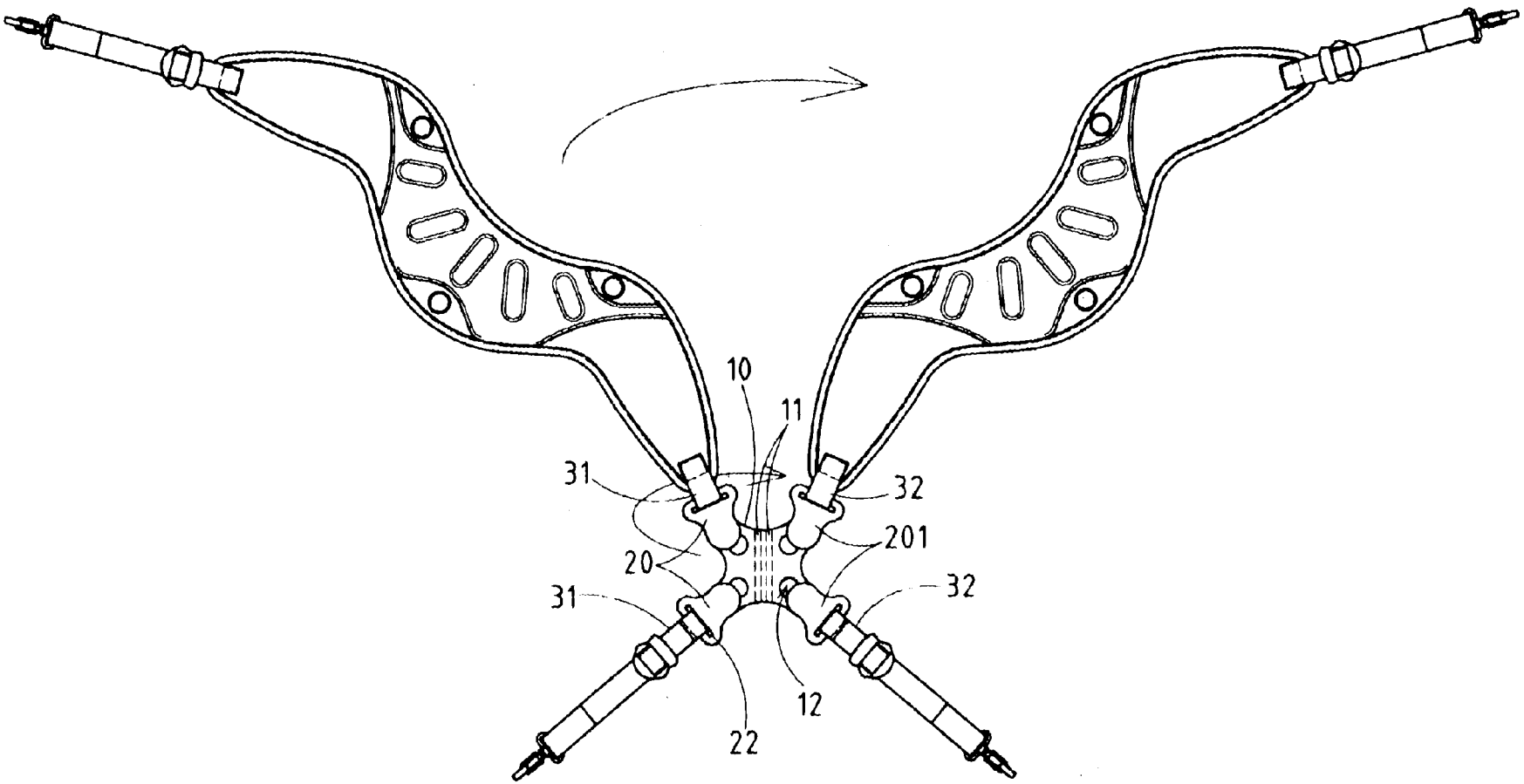
FIG. 6 shows a schematic view of the working of the unfolded main body of the first preferred embodiment of the present invention.

As shown in FIG. 4, the present invention is employed to fasten two shoulder straps 31 and 32 of a golf bag 40. In the event that the shoulder straps 31 and 32 are caused to lean to one side when the golf bag 40 is being carried on the back of a person, the swaying of the golf bag 40 is alleviated by virtue of the fact that the movable connectors 20 and 201 are capable of swiveling, as illustrated in FIG. 5.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A buckle structure for fastening two shoulder straps and the like, said buckle structure comprising:

a foldable main body comprising, in a center, two folding grooves, in one end, two first retaining holes, and in another end, two second retaining holes whereby said two second retaining holes whereby said two second retaining holes are aligned with said two first retaining holes at the time when said main body is folded, two first movable connectors provided at one end with a strap hole for fastening one end of a first shoulder strap, said two first movable connectors further provided at the other end with a connection shaft which is provided at a free end with a retaining slot whereby said two first movable connectors are movably retained by said connection shaft in said two first retaining holes of said main body, and two second movable connectors provided at one end with a strap hole for fastening one end of a second shoulder strap, said two second movable connectors further provided at the other end with a connection shaft which is provided at a free end with a retaining projection whereby said two second movable connectors are movably retained by said connection shaft in said two second retaining holes of said main body, said retaining projection of said connection shaft of said two second movable connectors being removably retained in said retaining slot of said connection shaft of said two first movable connectors at the time when said main body is folded.

2. The buckle structure as defined in claim 1, wherein said two first retaining holes of said main body are comprised of a disengagement portion, an engagement portion smaller in hole diameter than said disengagement portion, and a guide portion located between said engagement portion and said disengagement portion;

wherein said connection shaft of said two first movable connectors is comprised of a shank, a head extending from said shank, and a retaining slot located in said head whereby said two first movable connectors are movably retained in said two first retaining holes of said main body such that said shank is capable of moving from said disengagement portion to said engagement portion via said guide portion, and vice versa, said head being dimensioned to move through said disengagement portion to result in disengagement of said first movable connectors with said main body;

wherein said two second retaining holes of said main body are comprised of a disengagement portion, an engagement portion smaller in hole diameter than said disengagement portion, and a guide portion situated between said disengagement portion and said engagement portion;

wherein said connection shaft of said two second movable connectors is comprised of a shank, a head extending from said shank, and a retaining projection extending from said head whereby said two second movable connectors are movably retained in said two second retaining holes of said main body such that said shank is capable of moving from said engagement portion to said disengagement portion via said guide portion, and vice versa, said head being dimensioned to move through said disengagement portion to result in disengagement of said second movable connectors with said main body, said retaining projection of said connection shaft of said two second movable connectors being removably retained in said retaining slot of said connection shaft of said two first movable connectors at the time when said main body is folded.

3. The buckle structure as defined in claim 1, wherein said main body is comprised of a center piece provided in a center with said two folding grooves; a first piece pivoted to one end of said center piece by a pivot and comprised of said two first retaining holes for retaining movably said two first movable connectors by which the first shoulder strap is fastened; and a second piece pivoted to the other end of said center piece by a pivot and comprised of said two second retaining holes for retaining movably said two second movable connectors by which the second shoulder strap is fastened.

* * * * *